US010001049B2

(12) United States Patent
Tsuchiya et al.

(10) Patent No.: US 10,001,049 B2
(45) Date of Patent: Jun. 19, 2018

(54) HEAT INSULATOR

(71) Applicants: TOYOTA JIDOSHA KABUSHIKI KAISHA, Toyota-shi (JP); KABUSHIKI KAISHA TOYOTA JIDOSHOKKI, Kariya-shi (JP)

(72) Inventors: Tomihisa Tsuchiya, Toyota (JP); Hiroshi Shimogasa, Kariya (JP); Shoichi Maeda, Kariya (JP)

(73) Assignees: TOYOTA JIDOSHA KABUSHIKI KAISHA, Toyota-shi (JP); KABUSHIKI KAISHA TOYOTA JIDOSHOKKI, Kariya-shi (JP)

( * ) Notice: Subject to any disclaimer, the term of this patent is extended or adjusted under 35 U.S.C. 154(b) by 142 days.

(21) Appl. No.: 15/058,797

(22) Filed: Mar. 2, 2016

(65) Prior Publication Data

US 2016/0258336 A1 Sep. 8, 2016

(30) Foreign Application Priority Data

Mar. 3, 2015 (JP) ..... 2015-041195

(51) Int. Cl.
*F01N 1/00* (2006.01)
*F01N 13/14* (2010.01)
(Continued)

(52) U.S. Cl.
CPC ..... *F01N 13/14* (2013.01); *F01N 13/102* (2013.01); *F01N 13/143* (2013.01);
(Continued)

(58) Field of Classification Search
USPC ..... 60/272, 298, 299, 320
See application file for complete search history.

(56) References Cited

U.S. PATENT DOCUMENTS 3,863,445 A * 2/1975 Heath ..... F01N 13/082 180/309
4,598,790 A * 7/1986 Uesugi ..... F01N 1/10 181/252

(Continued)

FOREIGN PATENT DOCUMENTS

JP 54-118912 U1 8/1979
JP 8-93470 A 4/1996

(Continued)

OTHER PUBLICATIONS

Australian Office Action dated Dec. 7, 2016 in Patent Application No. 2016201400.

*Primary Examiner* — Binh Q Tran
(74) *Attorney, Agent, or Firm* — Oblon, McClelland, Maier & Neustadt, L.L.P.

(57) ABSTRACT

A heat insulator includes a first covering part and a second covering part. The first covering part is configured to cover a bent part formed in an exhaust pipe of an internal combustion engine. The first covering part has a plurality of slits extending in a circumferential direction of the exhaust pipe. The plurality of slits are arranged with a given space from each other in a direction in which the exhaust pipe extends such that a plate part between slits is present between the plurality of slits. The second covering part covers the other part of the exhaust pipe than the bent part. At least a part of the second covering part is bonded to the exhaust pipe.

3 Claims, 6 Drawing Sheets

(51) Int. Cl.
*F01N 13/10* (2010.01)
*F01N 13/18* (2010.01)

(52) U.S. Cl.
CPC ..... *F01N 13/1888* (2013.01); *F01N 2260/10* (2013.01); *F01N 2310/02* (2013.01); *F01N 2470/24* (2013.01)

(56) References Cited

U.S. PATENT DOCUMENTS

| | | | | | |
|---|---|---|---|---|---|
| 4,619,292 | A * | 10/1986 | Harwood | F01N 13/14 | 138/111 |
| 5,726,397 | A * | 3/1998 | Mukai | F01N 1/003 | 181/232 |
| 6,435,272 | B1 * | 8/2002 | Voss | F01N 3/02 | 15/4 |
| 6,519,936 | B2 * | 2/2003 | Smatloch | F01N 3/0814 | 60/297 |
| 7,162,868 | B2 | 1/2007 | Funakoshi | | |
| 2005/0193726 | A1 | 9/2005 | Funakoshi | | |

FOREIGN PATENT DOCUMENTS

| | | | |
|---|---|---|---|
| JP | 10-266850 | | 10/1998 |
| JP | 2002-21554 | | 1/2002 |
| JP | 2004-353582 | A | 12/2004 |
| JP | 2005-042686 | A | 2/2005 |
| JP | 2005-248778 | A | 9/2005 |
| JP | 2005-307988 | | 11/2005 |
| KR | 2003-0092483 | A | 12/2003 |

* cited by examiner

HEAT INSULATOR

INCORPORATION BY REFERENCE

The disclosure of Japanese Patent Application No. 2015-041195 filed on Mar. 3, 2015 including the specification, drawings and abstract is incorporated herein by reference in its entirety.

BACKGROUND OF THE INVENTION

1. Field of the Invention

The invention relates to a heat insulator that covers an exhaust pipe of an internal combustion engine. The invention especially relates to a heat insulator that covers an exhaust pipe having a bent part.

2. Description of Related Art

Conventionally, as disclosed in Japanese Patent Application Publication No. 2005-307988 (JP 2005-307988 A), a heat insulator assembled to an exhaust pipe through a sliding mechanism is known. The heat insulator disclosed in JP 2005-307988 A covers an exhaust pipe made from a straight pipe, and one end side of the heat insulator in a longitudinal direction (in a direction along an exhaust gas flow) is fixed to the exhaust pipe, and the other end side of the heat insulator is assembled to the exhaust pipe by a sliding mechanism so as to be able to move relative to the exhaust pipe. Therefore, even when high-temperature exhaust gas flows inside the exhaust pipe causing the exhaust pipe to be thermally expanded in the longitudinal direction, and an amount of thermal expansion of the exhaust pipe and an amount of thermal expansion of the heat insulator differ from each other, it is unlikely that stress is generated in the heat insulator because the other end side of the heat insulator does not follow thermal expansion of the exhaust pipe.

SUMMARY OF THE INVENTION

The action of the sliding mechanism (that the other end side of the heat insulator does not follow thermal expansion of the exhaust pipe) is generated effectively in a case where the exhaust pipe is made from a straight pipe. However, when the exhaust pipe has a bent part, the following problem arises.

Here, a case is considered, in which a heat insulator 200 covers an exhaust pipe 100 having a bent part 102 shown in FIG. 8. In the exhaust pipe 100 shown in FIG. 8, an upstream side of the bent part 102 in an exhaust gas flow direction is inclined. The part that is inclined is referred to as an inclined part 101. A downstream side of the bent part 102 in the exhaust gas flow direction extends in a horizontal direction. The part extending in the horizontal direction is referred to as a horizontal part 103. The heat insulator 200 is provided with an inclined covering part 201 covering the inclined part 101 of the exhaust pipe 100, a bent covering part 202 covering the bent part 102, and a horizontal covering part 203 covering the horizontal part 103. One end of the inclined covering part 201 of the heat insulator 200 (an end part on the upstream side in the exhaust gas flow direction) is bonded to the inclined part 101 of the exhaust pipe 100 by welding or the like. One end of the horizontal covering part 203 of the heat insulator 200 (an end part on the downstream side in the exhaust gas flow direction) is assembled to the horizontal part 103 of the exhaust pipe 100 through a sliding mechanism 204 so as to be able to move relative to the horizontal part 103.

When the exhaust pipe 100 is thermally expanded (along the longitudinal direction of the exhaust pipe 100) as high-temperature exhaust gas flows inside the exhaust pipe 100, a direction of the thermal expansion of the horizontal part 103 is the horizontal direction (see arrow A in FIG. 8). As stated earlier, the sliding mechanism 204 functions for thermal expansion in the horizontal direction.

However, thermal expansion of the inclined part 101 happens obliquely downward (see arrow B in FIG. 8). Therefore, as shown in FIG. 9 (a sectional view of a periphery of the bent covering part 202), a part of the thermally-expanded exhaust pipe 100 comes into contact with the horizontal covering part 203 of the heat insulator 200, and a load in an obliquely downward direction could act on the horizontal covering part 203 from the exhaust pipe 100. In this case, stress is concentrated in a part where the heat insulator 200 is bonded to the exhaust pipe 100 (an end part of the inclined covering part 201 on the upstream side in the exhaust gas flow direction), which could cause an adverse effect (deterioration of bonding strength and so on) on this part.

Even in a structure in which one end of the horizontal covering part 203 of the heat insulator 200 (an end part on the downstream side in the exhaust gas flow direction) is bonded to the horizontal part 103 of the exhaust pipe 100, and one end of the inclined covering part 201 of the heat insulator 200 (an end part on the upstream side in the exhaust gas flow direction) is assembled to the inclined part 101 of the exhaust pipe 100 through a sliding mechanism so as to be able to move relative to the inclined part 101, there are instances where, similarly to the foregoing case, the part of the thermally-expanded exhaust pipe 100 comes into contact with the heat insulator 200, and stress is concentrated on the part where the heat insulator 200 is bonded to the exhaust pipe 100 (the end part of the horizontal covering part 203 on the downstream side in the exhaust gas flow direction).

The invention provides a heat insulator that is able to restrain an adverse effect on a part where the heat insulator is bonded to an exhaust pipe having a bent part even if the exhaust pipe is thermally expanded with respect to the heat insulator that covers the exhaust pipe.

A heat insulator according to an aspect of the invention includes a first covering part and a second covering part. The first covering part is configured to cover a bent part formed in an exhaust pipe of an internal combustion engine. The first covering part has a plurality of slits extending along a circumferential direction of the exhaust pipe. The plurality of slits are arranged with a given space from each other in a direction in which the exhaust pipe extends, such that a plate part between slits is present between the slits. The second covering part covers the other part of the exhaust pipe than the bent part. At least a part of the second covering part is bonded to the exhaust pipe.

With the heat insulator according to the above aspect, since the plurality of slits extending in the circumferential direction of the exhaust pipe are formed, when the exhaust pipe is thermally expanded and a load acts from the exhaust pipe, edge parts of the slits are deformed in directions in which opening widths of the slits are expanded (deformed in a so-called expanding direction). The deformation absorbs the load acting on the heat insulator. Further, in the heat insulator according to the invention, the plate part between slits is formed between the slits. Therefore, even when the exhaust pipe is thermally expanded and a load acts from the exhaust pipe, the plate part between slits is deformed in accordance with a direction of action of the load, thereby absorbing the load acting on the heat insulator. These effects of absorbing the load restrain concentration of stress in a part where the heat insulator is bonded to the exhaust pipe.

In the heat insulator according to the foregoing aspect, the first covering part may be positioned in a part, which covers the bent part, of a first insulator part that covers a half of a circumference of the exhaust pipe in the circumferential direction. The second covering part may include an upstream covering part of the first insulator part, a downstream covering part of the first insulator part, a second insulator part, and a third insulator part. The upstream covering part may cover a half of a circumference of a upstream part, which is on a upstream side of the bent part in an exhaust gas flow direction, of the exhaust pipe in the circumferential direction. The downstream covering part may cover a half of a circumference of a downstream part, which is on a downstream side of the bent part in the exhaust gas flow direction, of the exhaust pipe in the circumferential direction. The second insulator part may cover the other half of the circumference of the upstream part of the exhaust pipe. The third insulator part may cover the other half of the circumference of the downstream part of the exhaust pipe. The second insulator part may be bonded to the upstream covering part of the first insulator part such that the upstream covering part and the second insulator part cover the entire circumference of the upstream part of the exhaust pipe. The third insulator part may be bonded to the downstream covering part of the first insulator part such that the downstream covering part and the third insulator part cover the entire circumference of the downstream part of the exhaust pipe. The third insulator part may be arranged with a space from the second insulator part. The upstream covering part of the first insulator part and the second insulator part are bonded to the exhaust pipe.

According to this aspect, the third insulator part is arranged with a space from the second insulator part. This means that the second insulator part and the third insulator part are not connected with each other. Thus, even when a load from the exhaust pipe acts on the third insulator part, the load is not transmitted directly from the third insulator part to the second insulator part. Although the load is transmitted from the third insulator part to the first insulator part, in the first insulator part, each of the slits formed in the covering part is deformed in the expanding direction and the plate part between slits is deformed. Therefore, concentration of stress is restrained in the part where the heat insulator is bonded to the exhaust pipe, thereby restraining an adverse effect being exerted on the part where the heat insulator is bonded.

In the heat insulator according to the foregoing aspect, the downstream covering part of the first insulator part and the third insulator part may be supported so as to slide with respect to the exhaust pipe.

According to this structure, when the downstream part of the exhaust pipe is thermally expanded, this part of the heat insulator does not follow the thermal expansion of the exhaust pipe.

With the heat insulator according to the foregoing aspect, the plurality of the slits are formed in the covering part that covers the bent part of the exhaust pipe.

Even when the exhaust pipe is thermally expanded and comes into contact with the heat insulator, deformation of the periphery of the slits makes it possible to restrain concentration of stress in the part where the heat insulator is bonded to the exhaust pipe. Thus, it is possible to restrain adverse effects on the part where the insulator is bonded.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

An embodiment of the invention is explained below based on the drawings. In this embodiment, a case is explained where the invention is applied as a heat insulator that covers an exhaust pipe for an automobile engine (for example, a diesel engine; an internal combustion engine).

Figure 1:
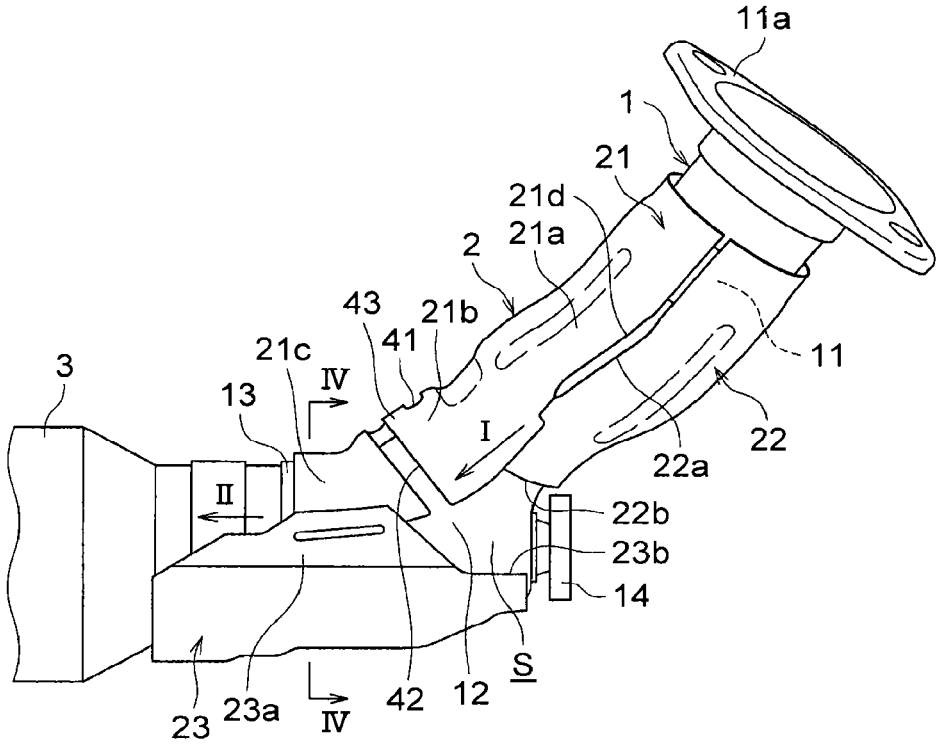
FIG. 1 is a side view of an exhaust pipe and a heat insulator according to an embodiment.
Figure 2:
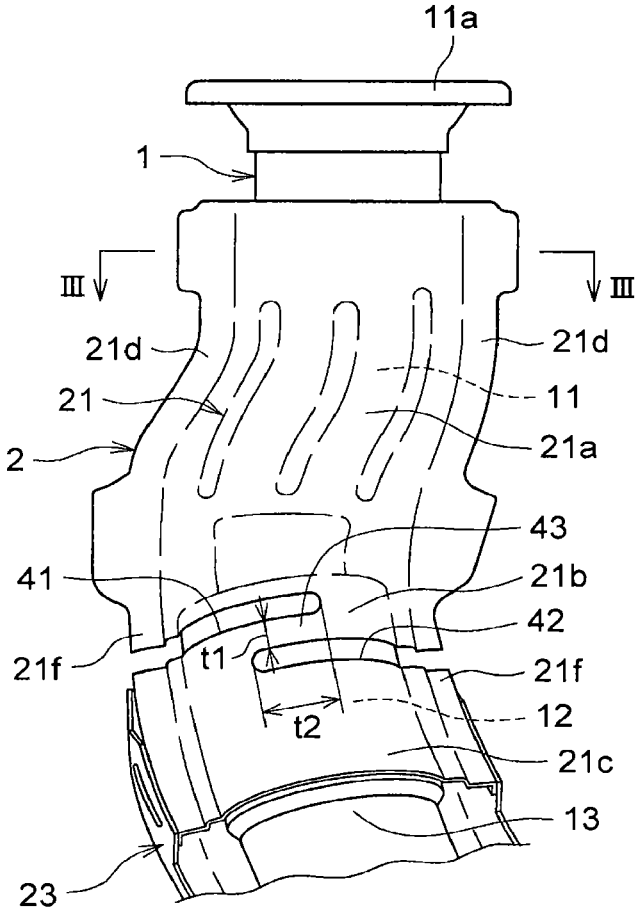
FIG. 2 is a plan view of the exhaust pipe and the heat insulator according to the embodiment.

FIG. 1 is a side view of an exhaust pipe 1 and a heat insulator 2 according to this embodiment. FIG. 2 is a plan view of the exhaust pipe 1 and the heat insulator 2 according to this embodiment.

The exhaust pipe 1 is formed from stainless steel, aluminum alloy, or the like, includes an inclined part 11, a bent part 12, and a horizontal part 13 from an upstream side (the upper right side in FIG. 1 and the upper side in FIG. 2) through a downstream side (the left side in FIG. 1 and the lower side in FIG. 2) in an exhaust gas flow direction, and is made by integrally forming the inclined part 11, the bent part 12, and the horizontal part 13. The above-mentioned inclined part 11 corresponds to an upstream part according to the invention (an upstream part, that is a part of the exhaust pipe 1 on the upstream side of the bent part 12 in the exhaust gas flow direction), and the horizontal part 13 corresponds to a downstream part according to the invention (a downstream part, that is a part of the exhaust pipe 1 on the downstream side of the bent part 12 in the exhaust gas flow direction).

When a vehicle is on a horizontal road surface, the inclined part (the upstream part) 11 has a shape that is inclined downwardly from the upstream side in the exhaust gas flow direction towards the downstream side in the exhaust gas flow direction. The inclined part 11 includes a flange 11*a* in an end part of the inclined part 11 on the upstream side in the exhaust gas flow direction, and the flange 11*a* is connected with an exhaust manifold (not shown).

When the vehicle is on a horizontal road surface, the horizontal part (the downstream part) 13 has a shape extending in the horizontal direction from the upstream side in the exhaust gas flow direction to the downstream side in the exhaust gas flow direction. An end part of the horizontal part 13 on the downstream side in the exhaust gas flow direction is connected with a catalytic converter 3.

The bent part 12 is positioned between the inclined part 11 and the horizontal part 13, and, in the bent part 12, the upstream side in the exhaust gas flow direction is connected with the inclined part 11, and the downstream side in the exhaust gas flow direction is connected with the horizontal part 13.

Since the exhaust pipe 1 has such a shape, a flow direction of exhaust gas discharged during an operation of the engine is obliquely downward inside the inclined part 11, and the flow direction is changed from the obliquely downward direction to the horizontal direction inside the bent part 12. Then, the exhaust gas travels in the horizontal direction inside the horizontal part 13 (the left side in FIG. 1).

When the exhaust gas flows inside the exhaust pipe 1, the exhaust pipe 1 receives heat from the exhaust gas and is thermally expanded. Due to the thermal expansion, the length dimension of the exhaust pipe 1 increases.

Superficially, since an end part of the inclined part 11 on the upstream side in the exhaust gas flow direction is connected with the engine through the exhaust manifold (connected with a highly-rigid part), the thermal expansion of the inclined part 11 happens so that the end part of the inclined part 11 on the downstream side in the exhaust gas flow direction moves obliquely downward (see arrow I in FIG. 1), and the length dimension of the inclined part 11 increases.

Further, the bent part 12 continues from the inclined part 11. Therefore, as the end part of the inclined part 11 on the downstream side in the exhaust gas flow direction moves obliquely downward as stated above, the bent part 12 also moves in the same direction (obliquely downward) by an amount of the expansion of the inclined part 11.

The horizontal part 13 continues from the inclined part 11 through the bent part 12. Therefore, as the end part of the inclined part 11 on the downstream side in the exhaust gas flow direction moves obliquely downward as stated above, an end part of the horizontal part 13 on the upstream side in the exhaust gas flow directional so moves in the same direction (obliquely downward) by the amount of the expansion of the inclined part 11. Further, the length dimension of the horizontal part 13 increases as the horizontal part 13 thermally expands in a way that the end part of horizontal part 13 in the downstream side in the exhaust gas flow direction moves to the left in FIG. 1 (see arrow II in FIG. 1).

The heat insulator 2 is formed from a plate material such as stainless steel sheet and aluminum-plated steel sheet, is located adjacent to an outer periphery of the exhaust pipe 1, and covers the outer circumference of the exhaust pipe 1. Thus, heat of exhaust gas flowing in the exhaust pipe 1 is restrained from being radiated outside. This means that the heat insulator 2 is able to restrain thermal radiation to, for example, a floor panel (not shown), and is able to prevent thermal deformation of a resin component in the case where the resin component is arranged near the exhaust pipe 1.

The heat insulator 2 according to this embodiment has a structure in which the three insulator parts, namely, the first, second, and third insulator parts 21, 22, 23 are integrally bonded to each other by means of, for example, welding.

The first insulator part 21 is arranged across upper parts of the inclined part 11, the bent part 12, and the horizontal part 13 of the exhaust pipe 1. This means that the first insulator part 21 is provided with an inclined covering part 21*a* that covers an upper half of the circumference of the inclined part 11 of the exhaust pipe 1 in the circumferential direction, a bent covering part 21*b* that covers an upper half of the circumference of the bent part 12 in the circumferential direction, and a horizontal covering part 21*c* that covers an upper half of the horizontal part 13 in the circumferential direction. The inclined part 11 is positioned in the part on the upstream side of the bent part 12 of the exhaust pipe 1 in the exhaust gas flow direction. The horizontal part 13 is positioned in the part on the downstream side of the bent part of the exhaust pipe 1 in the exhaust gas flow direction. The inclined covering part 21*a*, the bent covering part 21*b*, and the horizontal covering part 21*c* have generally semicircular sectional shapes in a direction orthogonal to a direction in which the exhaust pipe 1 extends.

The second insulator part 22 is arranged below the inclined part 11 of the exhaust pipe 1. The second insulator part 22 has a shape that is generally symmetrical with respect to the inclined covering part 21*a* of the first insulator part 21, and covers the entire circumference of the inclined part 11 of the exhaust pipe 1, together with the inclined covering part 21*a*.

Figure 3:
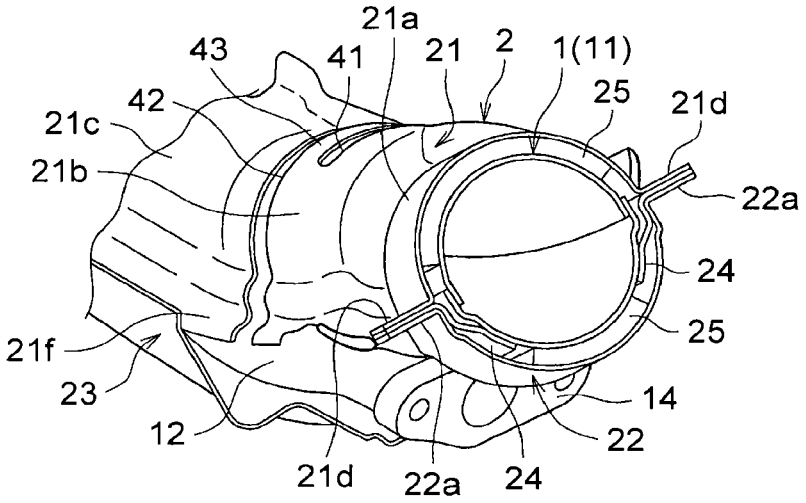
FIG. 3 is a perspective view of the exhaust pipe and the heat insulator on a downstream side in an exhaust gas flow direction with respect to a position along the line III-III in FIG. 2.

Superficially, flanges 21*d*, 22*a* extending in the horizontal direction are formed in outer edge parts of the inclined covering part 21*a* of the first insulator part 21 and the second insulator part 22, respectively. Being bonded to each other by means of, for example, welding, the flanges 21*d*, 22*a* are integrated with each other. Thus, the inclined covering part 21*a* of the first insulator part 21 and the second insulator part 22 cover the entire circumference of the inclined part 11 of the exhaust pipe 1. To be more specific, as shown in FIG. 3 (a perspective view of the exhaust pipe 1 and the heat insulator 2 on the downstream side in the exhaust gas flow direction with respect to the position along the line III-III in FIG. 2), in the bonded part of the inclined covering part 21*a* of the first insulator part 21 and the second insulator part 22, a part of an insulator supporting bracket 24 is sandwiched between the flanges 21*d*, 22*a* and bonded integrally, and the insulator supporting bracket 24 is welded to an outer surface of the inclined part 11 of the exhaust pipe 1. Thus, the heat insulator 2 is supported by the exhaust pipe 1.

Further, heat insulation materials 25, 25 made from glass wool, ceramic fiber and so on is interposed between the outer surface of the inclined part 11 of the exhaust pipe 1, and the inclined covering part 21*a* of the first insulator part 21 and the second insulator part 22. The heat insulation materials 25, 25 may be arranged across an entire or partial region of the inclined part 11 of the exhaust pipe 1 in the longitudinal direction.

The third insulator part 23 is arranged below the horizontal part 13 of the exhaust pipe 1. The third insulator part 23 covers the entire circumference of the horizontal part 13 of the exhaust pipe 1, together with the horizontal covering part 21*c* of the first insulator part 21.

Figure 4:
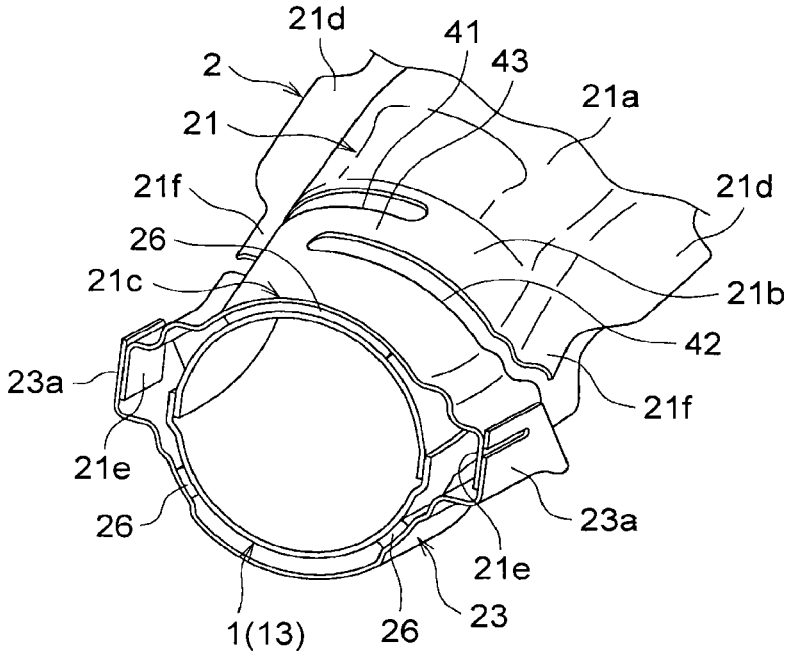
FIG. 4 is a perspective view showing the exhaust pipe and the heat insulator on an upstream side in the exhaust gas flow direction with respect to a position along the line IV-IV in FIG. 1.

Specifically, as shown in FIG. 4, (a perspective view of the exhaust pipe 1 and the heat insulator 2 on the upstream side in the exhaust gas flow direction with respect to the position along the line IV-IV in FIG. 1), flanges 21*e*, 23*a* extending the horizontal direction and then in the vertical direction are formed in outer edge parts of the horizontal covering part 21*c* of the first insulator part 21 and the third insulator part 23, respectively. Part of the flanges 21*e*, 23*a* extending in the vertical direction are superimposed on each other, and then bonded to each other by means of, for example, welding. Thus, the horizontal covering part 21*c* of the first insulator part 21 and the third insulator part 23 are integrated with each other, and cover the entire circumference of the horizontal part 13 of the exhaust pipe 1. Publicly-known SUS mesh 26, 26, 26 is interposed between the outer periphery of the exhaust pipe 1, and the horizontal covering part 21*c* of the first insulator part 21 and the third insulator part 23. Outer surfaces of the SUS mesh 26, 26, 26 are welded to the horizontal covering part 21*c* of the first insulator part 21 or the third insulator part 23. Inner surfaces of the SUS mesh 26, 26, 26 are not bonded to the outer periphery of the exhaust pipe 1, and are thus able to move relative to the exhaust pipe 1 (able to slide in the direction in which the exhaust pipe 1 extends). Hence, the horizontal covering part 21*c* of the first insulator part 21 and the third insulator part 23 are supported so as to be able to move relative to the exhaust pipe 1 through the SUS mesh 26, 26, 26, thereby structuring a sliding mechanism.

The heat insulator 2 according to this embodiment is provided with a given space S (see FIG. 1) between the second insulator part 22 and the third insulator part 23. This means that the given space S is provided between an end edge 22*b* of the second insulator part 22 on the downstream side in the exhaust gas flow direction, and an end edge 23*b* of the third insulator part 23 on the upstream side in the exhaust gas flow direction. Thus, the second insulator part 22 and the third insulator part 23 are structured so as not to be connected with each other directly. In the bent part 12 of the exhaust pipe 1, which faces the given space S between the second insulator part 22 and the third insulator part 23, a mounting part 14 for a urea water injector is provided. The urea water injector injects and supplies urea water into the exhaust pipe 1.

This embodiment is characterized by the structure of the bent covering part 21*b* of the first insulator part 21. Herein below, the structure of the bent covering part 21*b* of the first insulator part 21 is explained.

As shown in FIG. 1 to FIG. 4, two slits 41, 42 are formed in the bent covering part 21*b* of the first insulator part 21. As shown in FIG. 2, the slits 41, 42 extend along the circumferential direction of the exhaust pipe 1. Further, the slits 41, 42 have a given space (a dimension t1 in FIG. 2) from each other in the direction in which the exhaust pipe 1 extends, and a plate part between slits 43 is formed between the slits 41, 42. Here, the slit positioned on the upstream side in the exhaust gas flow direction is referred to as the first slit 41, and the slit positioned on the downstream side in the exhaust gas flow direction is referred to as the second slit 42. The dimension of the space between the slits 41, 42 (the dimension t1 in FIG. 2), and a length dimension t2 of the plate part between slits 43 along the circumferential direction of the exhaust pipe 1 (an overlap dimension between the slits 41, 42) are defined by experiments or simulations so that an amount of later-described twist deformation is ensured sufficiently. For example, the space dimension t1 between the slits 41, 42 is defined as 8 mm, and the length dimension t2 of the plate part between slits 43 is defined as 25 mm. The dimensions are not limited to these values.

More specifically, only one side is open in each of the slits 41, 42, and the opening direction of the first slit 41 and the opening direction of the second slit 42 are opposite to each other. This means that the first slit 41 is not open on one end side (the right side in FIG. 2) in its longitudinal direction, and is open on the other end side (the left side in FIG. 2). On the contrary, the second slit 42 is not open on the other end side (the left side in FIG. 2) in its longitudinal direction, and is open on the one end side (the right side in FIG. 2).

The position of the first slit 41 on the non-opening side (the right end position in FIG. 2) is set to be on the slightly right with respect to a center position of the bent covering part 21*b* of the first insulator part 21 in the width direction (the lateral direction in FIG. 2). In the structure of the first slit 41 on the opening side, the first slit 41 extends to a flange (a flange positioned on the left side in FIG. 2) 21*f* formed in the bent covering part 21*b* of the first insulator part 21, and is open in an end edge part of the flange 21*f*.

Meanwhile, the position of the second slit 42 on the non-opening side (the left end position in FIG. 2) is set to be on the slightly left with respect to the center position of the bent covering part 21*b* of the first insulator part 21 in the width direction. In the structure of the second slit 42 on the opening side, the second slit 42 extends to a flange (a flange positioned on the right side in FIG. 2) 21*f* formed in the bent covering part 21*b* of the first insulator part 21, and is open in an end edge part of the flange 21*f*.

With the foregoing structure, as stated above, the plurality of slits 41, 42 extending along the circumferential direction of the exhaust pipe 1 are formed in the bent covering part 21*b*. At the same time, the slits 41, 42 are formed with the given space that is present along the direction in which the exhaust pipe 1 extends. Thus, the plate part between slits 43 is formed between the slits 41, 42.

Next, operations when exhaust gas flows inside the exhaust pipe 1 are explained.

Figure 5:
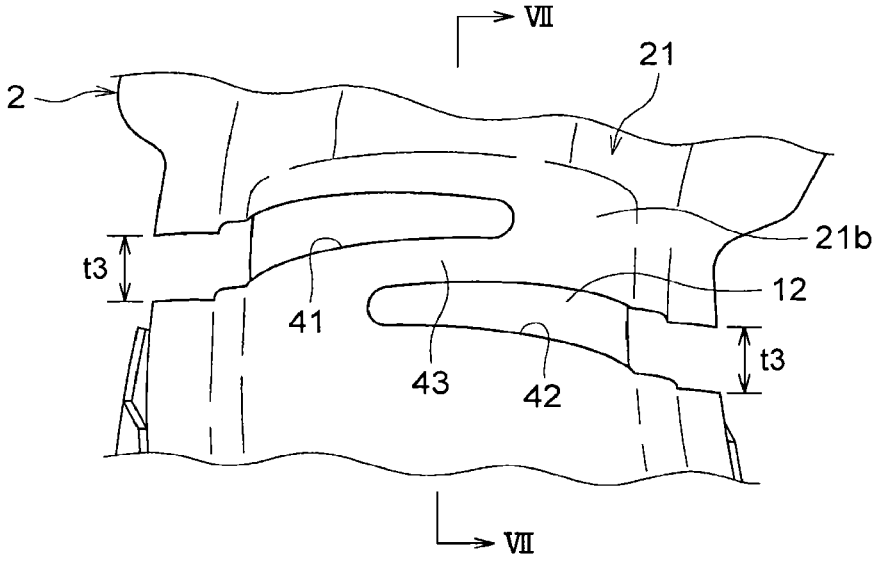
FIG. 5 is a plan view of a state in which a bent covering part of the heat insulator is deformed when the exhaust pipe is thermally expanded.

As stated above, the slits 41, 42 extending along the circumferential direction of the exhaust pipe 1 are formed in the heat insulator 2. Therefore, when the exhaust pipe 1 is thermally expanded, as shown in FIG. 5 (a plan view of a state where the bent covering part 21*b* of the heat insulator 2 is deformed when the exhaust pipe 1 is thermally expanded), edge parts of each of the slits 41, 42 formed in the bent covering part 21*b* are deformed in a direction expanding an opening width t3 of the slits 41, 42 (deformed in the expanding direction) in the bent covering part 21*b* of the first insulator part 21. Due to this deformation, a load acting on the heat insulator 2 (a load in an obliquely downward direction that acts when the exhaust pipe 1 comes into contact with the heat insulator 2 due to a difference between a thermal expansion direction of the inclined part 11 (see arrow I in FIG. 1) and a thermal expansion direction of the horizontal part 13 (see arrow 11 in FIG. 1) as stated earlier) is absorbed.

Figure 6:
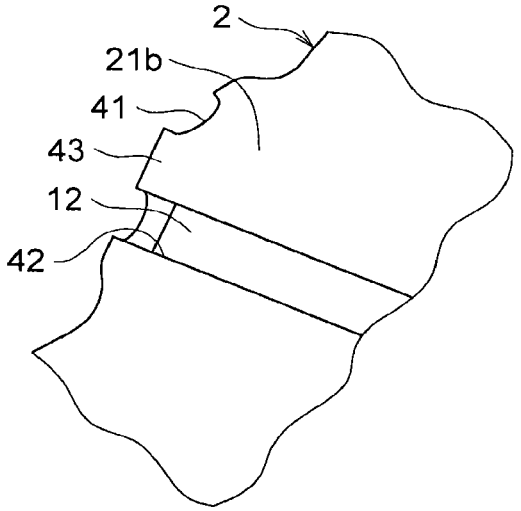
FIG. 6 is a side view of a state where the bent covering part of the heat insulator is deformed when the exhaust pipe is thermally expanded.
Figure 7:
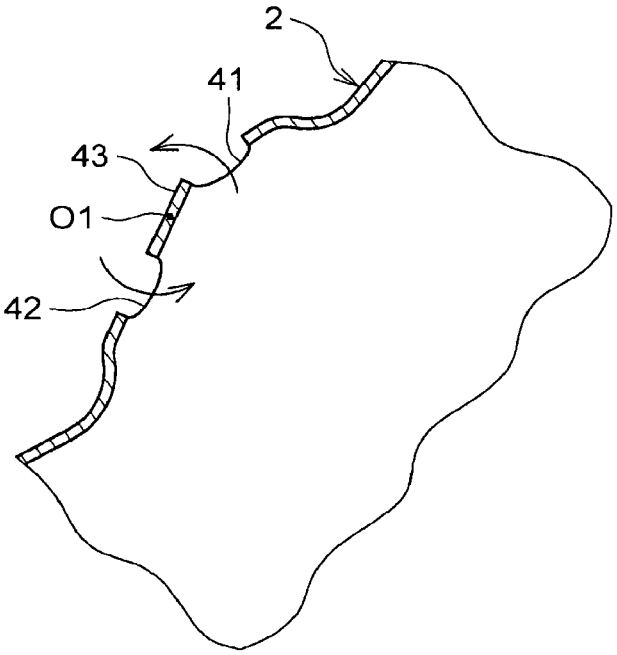
FIG. 7 is a sectional view of the heat insulator along the line VII-VII in FIG. 5.
Figure 8:
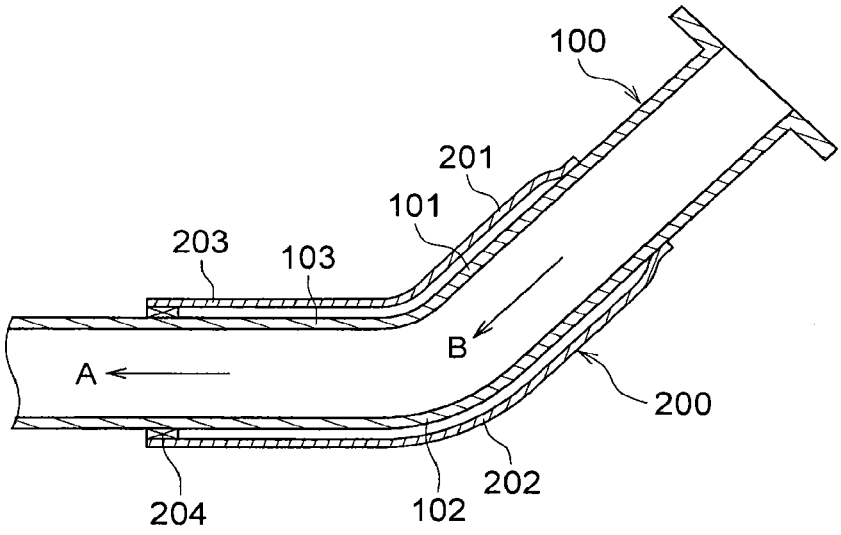
FIG. 8 is a sectional view of an example of an exhaust pipe and a conventional heat insulator.
Figure 9:
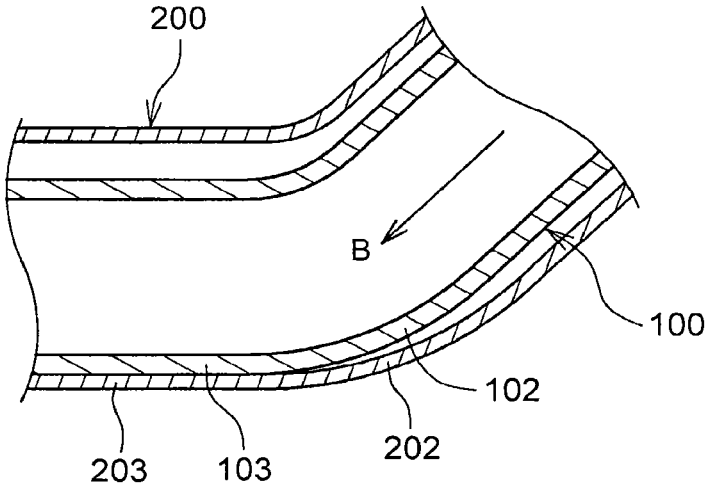
FIG. 9 is a sectional view of a periphery of a bent covering part in a state where a part of the thermally expanded exhaust pipe is in contact with the heat insulator.

Further, as stated earlier, in the heat insulator 2, the plate part between slits 43 is formed between the slits 41, 42. Therefore, when the exhaust pipe 1 is thermally expanded, as shown in FIG. 6 (a side view of a state where the bent covering part 21*b* of the heat insulator 2 is deformed when the exhaust pipe 1 is thermally expanded) and FIG. 7 (a sectional view of the heat insulator 2 taken along the line VII-VII in FIG. 5), twist deformation happens in the plate part between slits 43 about a central axis of twist O1 that extends in a direction generally orthogonal to the direction in which the exhaust pipe 1 extends (see arrows in FIG. 7). This deformation also absorbs the load acting on the heat insulator 2.

Since a load acting on the heat insulator 2 is absorbed as described above, concentration of stress is restrained in the part where the heat insulator 2 is bonded to the exhaust pipe 1. In other words, concentration of stress is restrained in a part where the inclined covering part 21*a* of the first insulator part 21 and the second insulator part 22 are bonded to the exhaust pipe 1 (a part where the inclined covering part 21*a* and the second insulator part 22 are bonded to the exhaust pipe 1 through the insulator supporting bracket 24). Thus, it is possible to restrain an adverse effect (such as deterioration of bonding strength) from being exerted on the part where the heat insulator 2 is bonded.

To be more specific, in the structure according to this embodiment, the second insulator part 22 is arranged below the inclined part 11 of the exhaust pipe 1 and is bonded to the inclined covering part 21*a* of the first insulator part 21. The third insulator part 23 is arranged below the horizontal part 13 of the exhaust pipe 1 and is bonded to the horizontal covering part 21*c* of the first insulator part 21. Further, there is a given space S between the third insulator part 23 and the second insulator part 22. This means that the second insulator part 22 and the third insulator part 23 are not connected with each other. Therefore, when a load in the downward direction acts on the third insulator part 23 from the exhaust pipe 1, the load is not transmitted directly from the third insulator part 23 to the second insulator part 22. The load is transmitted from the third insulator part 23 to the first insulator part 21. However, as described earlier, in the first insulator part 21, each of the slits 41, 42 formed in the bent covering part 21*b* is deformed in the expanding direction, and the plate part between slits 43 has twist deformation. Thus, concentration of stress is restrained in a part where the heat insulator 2 is bonded to the exhaust pipe 1, and it is possible to restrain an adverse effect from being exerted on the part where the heat insulator 2 is bonded.

Further, in the structure according to this embodiment, the horizontal covering part 21*c* of the first insulator part 21 and the third insulator part 23 are supported by the sliding mechanism so as to be able to slide with respect to the exhaust pipe 1. Therefore, when the horizontal part 13 of the exhaust pipe 1 is thermally expanded, this part of the heat insulator 2 does not follow the thermal expansion of the exhaust pipe 1.

In the embodiment explained so far, the case is explained in which the invention is applied as the heat insulator 2 that covers the exhaust pipe 1 of a diesel engine for an automobile. The invention is not limited to this, and may also be applied as a heat insulator that covers an exhaust pipe of a gasoline engine for an automobile. The invention may also be applied as a heat insulator that covers an exhaust pipe of an engine other than for automobiles.

In the foregoing embodiment, the inclined covering part 21*a* of the first insulator part 21 and the second insulator part 22 are bonded to the inclined part 11 of the exhaust pipe 1, and the horizontal covering part 21*c* of the first insulator part 21 and the third insulator part 23 are supported so as to be able to slide with respect to the exhaust pipe 1. The invention is not limited to this, and the horizontal covering part 21*c* of the first insulator part 21 and the third insulator part 23 may be bonded to the inclined part 11 of the exhaust pipe 1, and the inclined covering part 21*a* of the first insulator part 21 and the second insulator part 22 may be supported so as to be able to slide with respect to the exhaust pipe 1. Each of these parts may also be bonded to the exhaust pipe 1.

In the foregoing embodiment, the slits 41, 42 have shapes extending in the circumferential direction that is generally orthogonal to the direction in which the exhaust pipe 1 extends. The invention is not limited to this, and the slits 41, 42 may have shapes extending in a direction inclined at a given angle (for example, about 30°) from the circumferential direction orthogonal to the direction in which the exhaust pipe 1 extends. The number of locations where slits 41, 42 are arranged is not limited to two, and may be three or more. In this case, it is preferred that opening directions of neighboring slits (opening directions in end edge parts of the flanges 21*f* formed in the bent covering part 21*b* of the first insulator part 21) are opposite to each other.

Further, in the foregoing embodiment, the heat insulator 2 is structured so that the three insulator parts, namely, the first, second, and third insulator parts 21, 22, 23 are integrally connected with each other. The invention is not limited to this, and the heat insulator may have a structure in which four or more insulator parts are integrally connected with each other, or may have a structure in which two insulator parts are integrally connected with each other. Alternatively, a structure may be applicable in which the heat insulator 2 is provided with a part that covers a lower half of the bent part 12 of the exhaust pipe 1.

Further, explained in the foregoing embodiment is the heat insulator 2 applied to the exhaust pipe 1 in which the upstream part of the bent part 12 in the exhaust gas flow direction is an inclined pipe (the inclined part 11), and the downstream part of the bent part 12 in the exhaust gas flow direction is a pipe extending in the horizontal direction (the horizontal part 13). The heat insulator 2 according to the invention is not limited to this, and is still able to obtain similar effects as long as the upstream part and the downstream part of the bent part 12 in the exhaust pipe 1 extend in different directions.

The invention is applicable to a heat insulator that covers an exhaust pipe having a bent part.

What is claimed is:

1. A heat insulator comprising:

a first covering part configured to cover a bent part formed in an exhaust pipe of an internal combustion engine, the first covering part having a plurality of slits extending along a circumferential direction of the exhaust pipe, the plurality of slits being arranged with a given space from each other in a direction in which the exhaust pipe extends, such that a plate part between slits is present between the slits; and a second covering part covering a part of the exhaust pipe other than the bent part, at least a part of the second covering part being bonded to the exhaust pipe, wherein only one side of each of the slits is open, and opening directions of the slits are opposite to each other.

2. The heat insulator according to claim 1, wherein the first covering part is positioned in a part, which covers the bent part, of a first insulator part that covers a half of a circumference of the exhaust pipe in the circumferential direction, the second covering part includes an upstream covering part of the first insulator part, a downstream covering part of the first insulator part, a second insulator part, and a third insulator part, the upstream covering part covering a half of a circumference of a upstream part, which is on a upstream side of the bent part in an exhaust gas flow direction, of the exhaust pipe in the circumferential direction, the downstream covering part covering a half of a circumference of a downstream part, which is on a downstream side of the bent part in the exhaust gas flow direction, of the exhaust pipe in the circumferential direction, the second insulator part covering the other half of the circumference of the upstream part of the exhaust pipe, the third insulator part covering the other half of the circumference of the downstream part of the exhaust pipe, the second insulator part is bonded to the upstream covering part of the first insulator part such that the upstream covering part and the second insulator part cover the entire circumference of the upstream part of the exhaust pipe, the third insulator part is bonded to the downstream covering part of the first insulator part such that the downstream covering part and the third insulator part cover the entire circumference of the downstream part of the exhaust pipe, the third insulator part being arranged with a space from the second insulator part, and the upstream covering part of the first insulator part and the second insulator part are bonded to the exhaust pipe.

3. The heat insulator according to claim 2, wherein the downstream covering part of the first insulator part and the third insulator part are supported so as to slide with respect to the exhaust pipe.

* * * * *